US009181890B2

(12) United States Patent
Sturman

(10) Patent No.: US 9,181,890 B2
(45) Date of Patent: Nov. 10, 2015

(54) METHODS OF OPERATION OF FUEL INJECTORS WITH INTENSIFIED FUEL STORAGE

(71) Applicant: Oded Eddie Sturman, Woodland Park, CO (US)

(72) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 264 days.

(21) Appl. No.: 13/681,240

(22) Filed: Nov. 19, 2012

(65) Prior Publication Data

US 2014/0138454 A1 May 22, 2014

(51) Int. Cl.

| | |
|---|---|
| ***F02D 1/06*** | (2006.01) |
| ***F02D 41/20*** | (2006.01) |
| ***F02M 1/18*** | (2006.01) |
| ***F02M 47/02*** | (2006.01) |
| ***F02M 57/02*** | (2006.01) |
| ***F02M 51/06*** | (2006.01) |

(52) U.S. Cl.

CPC ..... *F02D 41/20* (2013.01); *F02M 1/18* (2013.01); *F02M 47/02* (2013.01); *F02M 51/061* (2013.01); *F02M 57/02* (2013.01); *F02M 57/025* (2013.01); *F02D 2200/0602* (2013.01); *F02M 2200/40* (2013.01)

(58) Field of Classification Search

CPC ..... F02M 1/18; F02M 57/02; F02M 47/02; F02M 51/061

USPC ..... 239/1, 5, 69, 88–90, 92, 96, 124, 127, 239/585.1; 123/294, 299, 300, 305, 467

See application file for complete search history.

(56) References Cited

U.S. PATENT DOCUMENTS

| | | | |
|---|---|---|---|
| 1,701,089 | A | 2/1929 | von Salis |
| 2,537,087 | A | 1/1951 | Pyk et al. |
| 2,606,066 | A | 8/1952 | Thompson |
| 2,722,924 | A | 11/1955 | Hedges |

(Continued)

FOREIGN PATENT DOCUMENTS

| | | |
|---|---|---|
| DE | 10250130 | 3/2004 |
| DE | 102004030447 | 1/2006 |

(Continued)

OTHER PUBLICATIONS

Notice of Allowance Dated Nov. 21, 2013; U.S. Appl. No. 13/683,044.

(Continued)

*Primary Examiner* — Steven J Ganey

(74) *Attorney, Agent, or Firm* — Blakely Sokoloff Taylor & Zafman LLP

(57) ABSTRACT

Methods of operating fuel injectors with intensified fuel storage. At least one storage volume is provided in the intensifier type fuel injector, with a check valve between the intensifier and the needle chamber and storage volume preventing loss of injection pressure while the intensifier plunger cylinder is refilling with fuel. Using the check valve to isolate the storage volume from the intensifier to reduce and control pressure spikes that effect injector operation. This provides very efficient injector operation, particularly at low engine loads, by eliminating the wasted energy of compressing, venting and recompressing fuel for injection and reducing and controlling pressure spikes that effect injector operation.

15 Claims, 3 Drawing Sheets

(56) References Cited

U.S. PATENT DOCUMENTS

| | | | | |
|---|---|---|---|---|
| 3,640,466 | A | | 2/1972 | Steiger |
| 4,006,859 | A | | 2/1977 | Thoma |
| 4,173,208 | A | | 11/1979 | Fenne et al. |
| 4,219,154 | A | * | 8/1980 | Luscomb ..... 239/585.1 |
| 4,256,064 | A | | 3/1981 | Thorn |
| 4,440,132 | A | | 4/1984 | Terada et al. |
| 4,627,571 | A | | 12/1986 | Kato et al. |
| 4,628,881 | A | * | 12/1986 | Beck et al. ..... 239/96 |
| 4,782,794 | A | | 11/1988 | Hsu et al. |
| 4,821,689 | A | | 4/1989 | Tittizer et al. |
| 4,856,713 | A | | 8/1989 | Burnett |
| 5,108,070 | A | | 4/1992 | Tominaga |
| 5,237,976 | A | | 8/1993 | Lawrence et al. |
| 5,241,935 | A | * | 9/1993 | Beck et al. ..... 123/300 |
| 5,341,783 | A | | 8/1994 | Beck et al. |
| 5,419,492 | A | | 5/1995 | Gant et al. |
| 5,421,521 | A | | 6/1995 | Gibson et al. |
| 5,423,484 | A | | 6/1995 | Zuo |
| 5,429,309 | A | | 7/1995 | Stockner |
| 5,440,968 | A | | 8/1995 | Sekine |
| 5,441,027 | A | | 8/1995 | Buchanon et al. |
| 5,460,329 | A | | 10/1995 | Sturman |
| 5,463,996 | A | | 11/1995 | Maley et al. |
| 5,529,044 | A | | 6/1996 | Barnes et al. |
| RE35,303 | E | | 7/1996 | Miller et al. |
| 5,551,398 | A | | 9/1996 | Gibson et al. |
| 5,638,781 | A | | 6/1997 | Sturman |
| 5,640,987 | A | | 6/1997 | Sturman |
| 5,641,121 | A | | 6/1997 | Beck et al. |
| 5,669,355 | A | | 9/1997 | Gibson et al. |
| 5,673,669 | A | | 10/1997 | Maley et al. |
| 5,682,858 | A | | 11/1997 | Chen et al. |
| 5,687,693 | A | | 11/1997 | Chen et al. |
| 5,697,342 | A | | 12/1997 | Anderson et al. |
| 5,713,316 | A | | 2/1998 | Sturman |
| 5,722,373 | A | | 3/1998 | Paul et al. |
| 5,727,525 | A | | 3/1998 | Tsuzuki |
| 5,732,679 | A | | 3/1998 | Takahasi et al. |
| 5,738,075 | A | | 4/1998 | Chen et al. |
| 5,752,659 | A | | 5/1998 | Moncelle |
| 5,771,865 | A | | 6/1998 | Ishida |
| 5,779,149 | A | | 7/1998 | Hayes, Jr. |
| 5,806,474 | A | | 9/1998 | Paul et al. |
| 5,826,562 | A | | 10/1998 | Chen et al. |
| 5,833,146 | A | | 11/1998 | Hefler |
| 5,873,526 | A | | 2/1999 | Cooke |
| 5,906,351 | A | | 5/1999 | Aardema et al. |
| 5,941,215 | A | | 8/1999 | Augustin |
| 5,950,931 | A | | 9/1999 | Beatty et al. |
| 5,954,030 | A | | 9/1999 | Sturman et al. |
| 5,960,753 | A | | 10/1999 | Sturman |
| 5,970,956 | A | | 10/1999 | Sturman |
| 5,979,803 | A | | 11/1999 | Peters et al. |
| 6,012,430 | A | | 1/2000 | Cooke |
| 6,012,644 | A | | 1/2000 | Sturman et al. |
| 6,026,785 | A | | 2/2000 | Zuo |
| 6,027,047 | A | | 2/2000 | Augustin |
| 6,047,899 | A | | 4/2000 | Graves |
| 6,085,991 | A | | 7/2000 | Sturman |
| 6,112,721 | A | | 9/2000 | Kouketsu et al. |
| 6,113,000 | A | | 9/2000 | Tian |
| 6,113,014 | A | | 9/2000 | Coldren et al. |
| 6,119,960 | A | | 9/2000 | Graves |
| 6,148,778 | A | | 11/2000 | Sturman |
| 6,161,770 | A | | 12/2000 | Sturman |
| 6,173,685 | B1 | | 1/2001 | Sturman |
| 6,257,499 | B1 | | 7/2001 | Sturman |
| 6,308,690 | B1 | | 10/2001 | Sturman |
| 6,328,003 | B1 | | 12/2001 | Gaertner et al. |
| 6,360,728 | B1 | | 3/2002 | Sturman |
| 6,374,784 | B1 | | 4/2002 | Tischer et al. |
| 6,378,497 | B1 | | 4/2002 | Keyster et al. |
| 6,412,706 | B1 | | 7/2002 | Guerrassi et al. |
| 6,415,749 | B1 | | 7/2002 | Sturman et al. |
| 6,474,304 | B1 | | 11/2002 | Lei |
| 6,550,453 | B1 | | 4/2003 | Tian |
| 6,557,506 | B2 | | 5/2003 | Sturman |
| 6,575,126 | B2 | | 6/2003 | Sturman |
| 6,575,384 | B2 | | 6/2003 | Ricco |
| 6,592,050 | B2 | | 7/2003 | Boecking |
| 6,647,966 | B2 | | 11/2003 | Tian et al. |
| 6,655,355 | B2 | | 12/2003 | Kropp et al. |
| 6,684,853 | B1 | | 2/2004 | Lei |
| 6,684,856 | B2 | | 2/2004 | Tanabe et al. |
| 6,684,857 | B2 | | 2/2004 | Boecking |
| 6,722,127 | B2 | | 4/2004 | Scuderi et al. |
| 6,745,958 | B2 | | 6/2004 | Lei |
| 6,766,792 | B2 | | 7/2004 | Messinger et al. |
| 6,769,635 | B2 | | 8/2004 | Stewart et al. |
| 6,776,138 | B2 | | 8/2004 | Mahr et al. |
| 6,802,298 | B2 | | 10/2004 | Yoshimura et al. |
| 6,811,103 | B2 | | 11/2004 | Gurich et al. |
| 6,830,202 | B2 | | 12/2004 | Coldren |
| 6,845,926 | B2 | | 1/2005 | Lei |
| 6,868,831 | B2 | | 3/2005 | Lei |
| 6,880,501 | B2 | | 4/2005 | Suh et al. |
| 6,908,040 | B2 | | 6/2005 | Dong et al. |
| 6,910,462 | B2 | | 6/2005 | Sun et al. |
| 6,910,463 | B2 | | 6/2005 | Oshizawa et al. |
| 6,918,358 | B2 | | 7/2005 | Hu |
| 6,951,204 | B2 | | 10/2005 | Shafer et al. |
| 7,108,200 | B2 | | 9/2006 | Sturman |
| 7,182,068 | B1 | | 2/2007 | Sturman et al. |
| 7,278,593 | B2 | | 10/2007 | Wang et al. |
| 7,293,547 | B2 | | 11/2007 | Ibrahim |
| 7,412,969 | B2 | | 8/2008 | Pena et al. |
| 7,568,632 | B2 | | 8/2009 | Sturman |
| 7,568,633 | B2 | | 8/2009 | Sturman |
| 7,694,891 | B2 | | 4/2010 | Sturman |
| 7,717,359 | B2 | | 5/2010 | Sturman |
| 7,753,037 | B2 | | 7/2010 | Hatamura |
| 7,841,324 | B2 | | 11/2010 | Dirker et al. |
| 2002/0053340 | A1 | | 5/2002 | Lei |
| 2003/0155437 | A1 | | 8/2003 | Lei |
| 2003/0178508 | A1 | | 9/2003 | Coldren |
| 2003/0183198 | A1 | | 10/2003 | Mahr et al. |
| 2003/0196646 | A1 | | 10/2003 | Shoyama et al. |
| 2004/0000600 | A1 | | 1/2004 | Peters et al. |
| 2004/0129255 | A1 | | 7/2004 | Stuhldreher et al. |
| 2004/0140161 | A1 | | 7/2004 | Clancy et al. |
| 2004/0168673 | A1 | | 9/2004 | Shinogle |
| 2004/0188537 | A1 | | 9/2004 | Sturman |
| 2004/0195385 | A1 | | 10/2004 | Lawrence et al. |
| 2004/0238657 | A1 | | 12/2004 | Sturman |
| 2005/0066918 | A1 | | 3/2005 | Yamakawa et al. |
| 2005/0092306 | A1 | | 5/2005 | Shinogle et al. |
| 2006/0032940 | A1 | | 2/2006 | Boecking |
| 2006/0075995 | A1 | | 4/2006 | Liu et al. |
| 2006/0123773 | A1 | | 6/2006 | Zhang |
| 2006/0150931 | A1 | | 7/2006 | Sturman |
| 2006/0150954 | A1 | | 7/2006 | Moore |
| 2006/0157581 | A1 | | 7/2006 | Kiss et al. |
| 2006/0243253 | A1 | | 11/2006 | Knight |
| 2007/0209615 | A1 | | 9/2007 | Epshteyn |
| 2007/0251220 | A1 | | 11/2007 | Dawson et al. |
| 2007/0272221 | A1 | | 11/2007 | Branyon et al. |
| 2008/0277504 | A1 | | 11/2008 | Sturman |
| 2009/0056670 | A1 | | 3/2009 | Zhao et al. |
| 2009/0151686 | A1 | | 6/2009 | Nguyen |
| 2009/0283061 | A1 | | 11/2009 | Branyon et al. |
| 2010/0012745 | A1 | | 1/2010 | Sturman |
| 2010/0186716 | A1 | | 7/2010 | Sturman |
| 2011/0094462 | A1 | | 4/2011 | Durrett et al. |
| 2011/0163177 | A1 | | 7/2011 | Kiss |
| 2013/0075498 | A1 | | 3/2013 | Sturman |

FOREIGN PATENT DOCUMENTS

| | | |
|---|---|---|
| DE | 102005028400 | 2/2006 |
| DE | 102005060647 | 6/2006 |
| EP | 1593839 | 11/2005 |
| JP | 61/008459 | 1/1986 |
| JP | 61/096169 | 5/1986 |

(56) References Cited

FOREIGN PATENT DOCUMENTS

| | | |
|---|---|---|
| WO | WO-02/073024 | 9/2002 |
| WO | WO-2006/008727 | 1/2006 |
| WO | WO-2008/141237 | 11/2008 |

OTHER PUBLICATIONS

Office Action Dated Dec. 10, 2013; Chinese Patent Application No. 200980136227.6.
Office Action Dated Nov. 25, 2013; European Patent Application No. 09790488.2.
Advisory Action Dated May 29, 2012, U.S. Appl. No. 12/751,118.
International Search Report and Written Opinion of the International Searching Authority Dated Aug. 21, 2008, International Application No. PCT/US2008/063321.
International Search Report and Written Opinion of the International Searching Authority Dated Jan. 25, 2010, International Application No. PCT/US2009/050736.
Notice of Allowance Mailed Dec. 30, 2009, U.S. Appl. No. 12/118,542.
Notice of Allowance Mailed Jun. 27, 2011, Chinese Patent Application No. 200880015290.X.
Office Action Dated Jul. 13, 2012, European Patent Application No. 09790488.2.
Office Action Dated Sep. 13, 2011, European Patent Application No. 09790488.2.
Office Action Dated Aug. 23, 2012, U.S. Appl. No. 12/502,827.
Office Action Dated Aug. 31, 2012; Chinese Patent Application No. 200980136227.6.
Office Action Dated Dec. 31, 2010, Chinese Patent Application No. 200880015290.X.
Office Action Dated Dec. 5, 2012, Chinese Patent Application No. 201110259364.8.
Office Action Dated Mar. 5, 2012, U.S. Appl. No. 12/751,118.
Office Action Dated May 22, 2012, U.S. Appl. No. 12/502,827.
Office Action Dated Nov. 7, 2011, U.S. Appl. No. 12/751,118.
Restriction Requirement Dated Mar. 12, 2013, U.S. Appl. No. 13/683,044.
International Search Report and Written Opinion of the International Searching Authority Dated Jun. 24, 2014; International Application No. PCT/US2013/070628.
Office Action Dated Aug. 28, 2014; European Patent Application No. 09790488.2.
Notification on Grant of Patent Right for Invention Dated May 30, 2013; Chinese Patent Application No. 201110259364.8.
Office Action Dated Apr. 22, 2013; Chinese Patent Application No. 200980136227.6.
Office Action Dated Apr. 25, 2013, U.S. Appl. No. 13/683,044.
Notice of Allowance Mailed Jul. 5, 2013; U.S. Appl. No. 12/751,118.

* cited by examiner

METHODS OF OPERATION OF FUEL INJECTORS WITH INTENSIFIED FUEL STORAGE

BACKGROUND OF THE INVENTION

1. Field of the Invention

The present invention relates to the field of fuel injectors, fuel injection systems and methods of operation thereof.

2. Prior Art

Fuel injector performance, particularly in diesel engines, has a substantial influence in overall engine performance, especially with respect to emissions. Of particular importance is the speed at which fuel injection can be terminated. In particular, if fuel injection is terminated merely by the reduction in injection pressure it is difficult to rapidly terminate injection because of the compressibility of the fuel and actuation fluid in an intensifier type fuel injector, resulting in a trail off in atomization resulting in unacceptable levels of unburned fuel in the exhaust. Accordingly various types of direct needle control have been proposed to provide injection control other than by controlling injection pressure.

Also fuel injectors, particularly diesel fuel injectors, are using ever increasing injection pressures, now going as high as 3000 bar (45,000 psi). Diesel fuel has a compressibility of approximately 1% per 67 bar (1000 psi), so that at the injection pressure, the fuel has been substantially compressed. In intensifier type fuel injectors, injection occurs directly as a result of intensification, so that injection begins on intensification and terminates on termination of intensification. Consequently the volume of fuel intensified is set equal to the maximum injection volume needed, plus of course some overhead volume for the needle chamber, passageways to the needle chamber, etc. At a partial power setting for the engine, much less than the maximum injection volume is needed, yet the full amount is compressed and then depressurized, losing the energy required for the compression of the fuel not injected, which at low power settings and at idle, can be most of the substantial amount of energy used for intensification. In fuel injectors having direct needle control, the operation is a bit different, in that intensification occurs, then injection by the direct needle control, then termination of injection, again by direct needle control, and then depressurization to refill the intensification chamber for the next cycle. While this cycle is a bit different, the losses of intensification energy are not different.

Injectors using direct needle control to control injection of fuel supplied to the injector at injection pressure from an external source are also known. These injection systems are more efficient because fuel, once compressed, is sooner or later all injected regardless of the engine power setting. They also have the advantage of not cycling the fuel pressure in the needle chamber on each injection event, helping reduce, but not eliminate, the possibility of eventual injector tip breakage. However such systems have serious drawbacks. Aside from the safety issues of having a rail at injection pressures and the associated plumbing problems, there is a serious risk to the engine, in that if an injection tip breaks off, a direct and continuous flow path from the high pressure rail to the combustion chamber is provided, which could result in a hydraulic lock of the engine with catastrophic results.

Also known are methods of operation of intensifier type fuel injectors whereby a quantity of fuel is intensified by an intensifier and injection is controlled by direct needle control with the intensifier still being active until the remaining intensified fuel is less than needed for the next injection event or a portion of an injection event, at which time the intensifier is deactivated to refill the intensifier with fuel. Then the intensifier is activated again for subsequent injection events under control of the direct needle control. In U.S. Patent Application Publication No. 2010/0012745, a substantial storage volume for intensifier fuel is also provided in the injector. See also U.S. Patent Application Publication No. 2008/0277504. These methods of operation of fuel injectors are highly efficient, but it has been discovered, can be improved.

DETAILED DESCRIPTION OF THE PREFERRED EMBODIMENTS

Figure 1:
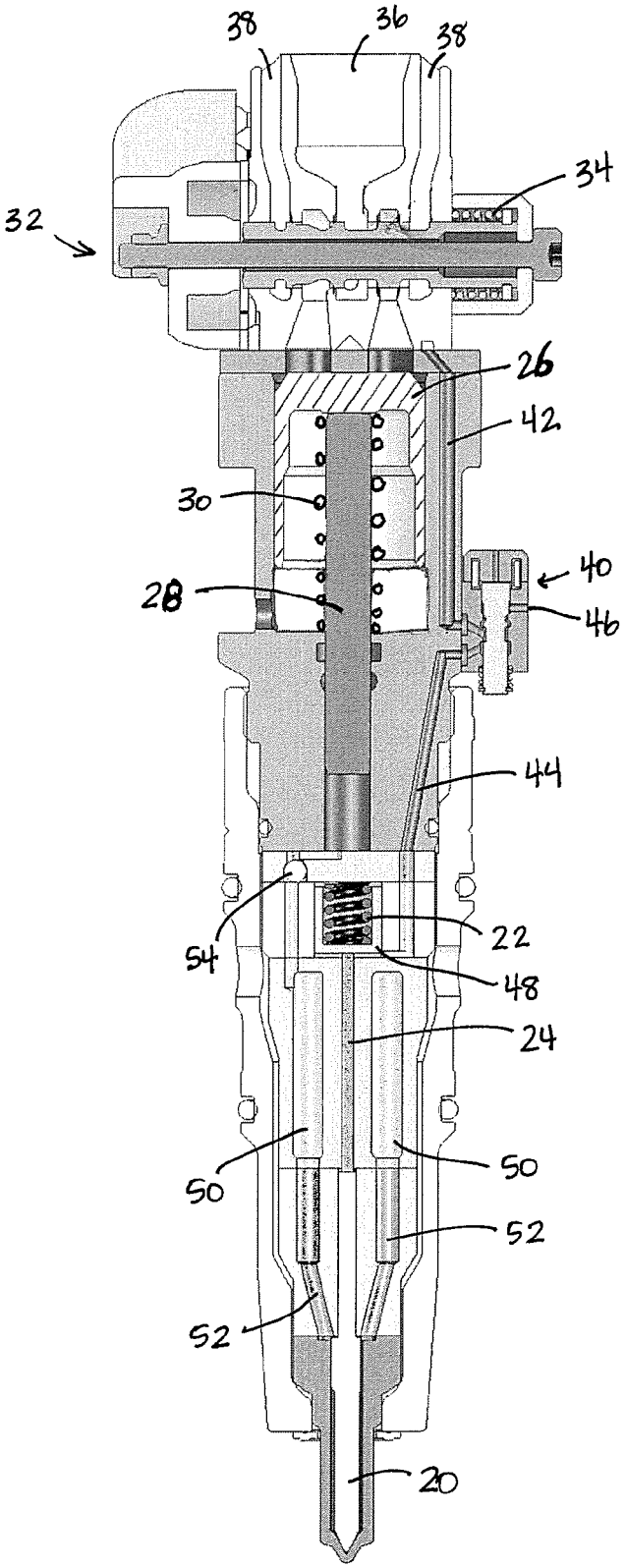
FIG. 1 is a cross section of a fuel injector that may be operated by a method accordance with the present invention.

In accordance with the present invention, the prior art method of intensifying a quantity of fuel and controlling the injection by direct needle control while the intensifier remains activated is modified to intensifying a quantity of fuel, then isolating the intensified fuel from the intensifier and keeping it isolated during subsequent injection events or injection sub-events. Such operation has been found to have a number of advantages over the prior art. Specifically, such operation has been found to control and greatly reduce pressure spikes in the intensified fuel which can cause mechanical deterioration of the injector. Also an injector operating in the prior art manner exhibits an undesired lack of repeatability, perhaps not detectable to one not looking closely, but which is in fact present, limiting the extent to which the performance of each cylinder of a multi-cylinder engine can be equalized. These effects may arise in part from the presence of a valve (preferably a check valve) between the intensifier and the bulk of intensified fuel, which when the intensifier is maintained active during injection, will partially or fully open during injection because of intensified fuel flow from the intensifier, with the check valve slamming shut after an injection event or injection sub-event because of the pressure spikes arising from the compressibility of the fuel, the pressures involved and speed of operation of the needle. Whatever the cause, it has been found that simply assuring that the check valve (or other valve) between the intensifier output and the bulk of the intensified fuel is closed during each injection event or injection sub-event controls and limits the pressure spike, which makes the injector operation very repeatable. This in turn allows the adjustment of the injection, cycle to cycle, so that the pressure profiles in the cylinders of a multi-cylinder engine can be made to be substantially equal to each other in amplitude, shape and timing with respect to crank angle.

Thus the present invention is a new method of operating an intensifier type injector, such as a prior art intensifier type injector, to obtain substantially enhanced useful life and operating characteristics. Accordingly a prior art intensifier type injector that may be used with the present invention will be first described, and then more details of the invention will be described.

In the description to follow, the phrase "injection event" refers to a complete injection event, which may comprise injection sub-events, such as, by way of one example, a pre-injection that will be followed by a main injection, either as a single main injection, or a series of smaller injections. An injection event may begin at any time after the end of a combustion cycle (power stroke) and will end before the end of the next combustion cycle (power stroke). Thus successive injection events in an engine operating in a two stroke or two cycle mode will occur on each engine crankshaft rotation (each 360 degrees of crankshaft rotation), while successive injection events in an engine operating in a four stroke or four cycle mode will occur on each pair of engine crankshaft rotations (each 720 degrees of crankshaft rotation).

First referring to FIG. 1, a cross section of one embodiment of an injector that may be used with the present invention may be seen. The injector includes a needle 20, normally held in the closed position by a spring 22 acting on an actuator pin 24 pushing against the top of the needle 20. The injector is an intensifier type injector with intensifier piston 26 actuated by lower pressure actuation fluid acting against the top of plunger 28, with coil spring 30 and fuel inlet pressure through a check valve (not shown) returning the intensifier piston 26 and plunger 28 to their unactuated position between injections. At the top of the injector is a single solenoid actuated three-way spool valve, generally indicated by the numeral 32, with spring return 34, which valve when in a first position will couple actuation fluid through port 36 to the region above the intensifier piston 26 or, alternatively, when in the second position, will couple the region above intensifier piston 26 to vents 38.

A second smaller spool valve generally indicated by the numeral 40 is coupled to the side of the injector for direct needle control. In a preferred embodiment, spool valve 40 is a three-way magnetically latching spool valve, magnetically latching on actuation, and releasing for spring return on receipt of a small reverse current, though other types of valves, including other spool valves may be used if desired. In the embodiment disclosed, the valve either couples actuation fluid pressure in line 42 to line 44 when actuated, or alternatively, blocks the flow of actuation fluid in line 42 and couples line 44 to a low pressure vent 46 when the spool is released. The area above piston 48 is permanently coupled to the source of actuation fluid under pressure, and accordingly is always pressurized when the engine is running. Through the three-way valve 40, pressure in line 44 controllably pressurizes the region under piston 48, which in turn controls actuator pin 24. For piston 48 and the intensifier, the actuation fluid is preferably engine oil, though some other actuation fluid may be used, such as fuel.

In the prior art, in operation, with the area under piston 48 vented, spring 22 and actuation fluid pressure above piston 48 will hold the needle closed, even against intensified fuel pressure in the needle chamber. When injection is to occur, needle control valve 40 is actuated to couple actuation fluid pressure to the region below piston 48, which pressure balances the piston 48, allowing intensified fuel pressure in the needle chamber to force the needle open against spring 22. Of course at the end of injection, the needle control valve 40 is released to again vent the area under piston 48 to allow actuation fluid pressure over piston 48 to force the needle closed. Of course the needle control valve 40 may be operated more than once, first to provide a pre-injection, followed by a second injection, or even to provide pulsed injections.

Figure 2:
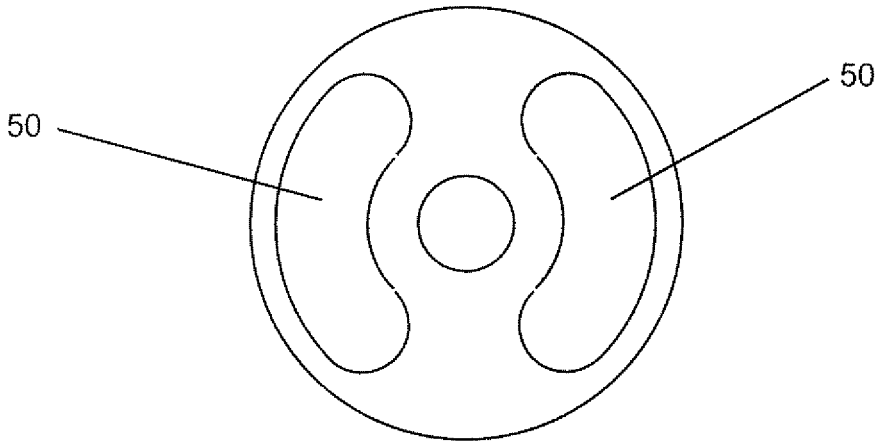
FIG. 2 is an illustration of the high pressure fuel storage in the lower section of the fuel injector.

Of particular importance to the present invention are the large storage volumes 50, also shown in the cross section of FIG. 2, the generous porting 52 and particularly the (ball) check valve 54. In the present invention, the storage of fuel at the intensified pressure is facilitated by check valve 54, which prevents depressurization of the intensified fuel pressure when the intensifier is deactivated (actuation pressure vented to a low pressure or a vent) so that, before the next injection event (or injection sub-event), spring 30 and fuel supply pressure can raise the intensifier piston 26 and intensifier plunger 28 to refill the volume under the intensifier plunger. Thus injection is controlled by the needle control valve 40 when the intensifier actuation fluid over the intensifier piston 26 is not pressurized, and therefore the check (or other) valve is closed, isolating the pressurized fuel in the storage volume used for injection from the intensifier, and particularly from the flow to and from the storage volume, in part due to the fuel compressibility, that causes or can cause the check valve to slam shut. This allows the direct needle control to control injection using the isolated and intensified fuel in the storage volume, with the compressibility of the intensified fuel maintaining the required injection pressure with relatively minimum pressure drop. In addition, if the intensifier is carefully proportioned relative to the amount of intensified fuel that may be injected before the pressure of the intensified fuel in the storage volume decreases more than desired (preferably but not necessarily amounting to a plurality of injection events, even at maximum power), and if the check valve is close to the outlet from the cylinder within which the intensifier plunger operates, then each intensifier stroke for fuel intensification may be a single complete (maximum or near maximum) stroke so that the amount of intensified fuel that is returned to a non-intensified pressure (on recycling of the intensifier) without injection will be a minimum, maximizing the efficiency of the intensification operation. Alternatively, multiple strokes of the intensifier piston and plunger may be used, in which case the last stroke preferably is a maximum or near maximum stroke.

The electronic control system that controls injection may also keep track of the amount of fuel injected on each injection event, and recycle the intensifier when required. Correction of the electronic control system for its errors in the amount of fuel injected on each injection event, if desired, may be made for each intensification cycle by obtaining some measure of the intensification pressure itself, such as by providing a measure of the intensifier actuation fluid pressure on the intensifier piston during intensification, and by limiting the stroke of the intensifier piston and plunger to slightly less than the maximum allowable, and sensing the intensifier piston and plunger position at the end of the intensifier intensification stroke. This may be done, by way of example, by using a hall-effect sensor or an electromagnetic sensor, and using the actuation fluid pressure times the intensification ratio as a measure of the intensified fuel pressure. Now a longer than expected stroke in comparison to the stroke expected for the amount of intensified fuel that was estimated to be needed to replenish the amount of fuel that was injected since the last intensification cycle is somewhat greater than estimated by the controller, so that appropriate corrections may be made in keeping track of the fuel injected after the last intensification cycle.

At idle and during low power settings, the intensifier need only be recycled after numerous injection events. Even at a maximum power setting, preferably (but not necessarily) the storage provided is adequate for multiple injection events. Depending on the relative volumes, initially the intensifier will likely need to be cycled more than once to adequately pressurize the fuel in the storage volume 50.

The present invention provides all the advantages and eliminates the disadvantages of a fuel rail at high injection pressures, and also substantially eliminates the high pressure spikes and improves the repeatability of the injector over that of injectors operated in accordance with U.S. Patent Application Publication No. 2010/0012745. In that regard, preferably the fuel in the total storage volume 50, after decompressing, is less than that that would cause a hydraulic lock in the engine cylinder if dumped into the cylinder on breakage of the injector tip. Also, the storage volume should not be so large as to jeopardize the structural integrity of the injector. Of course, while one exemplary form of direct needle control has been disclosed for purposes of setting the environment for the present invention, substantially any form of direct needle control may be used. Also while the check valve 54 is shown as a ball valve, other forms of check valves may also be used.

The exemplary embodiment of the injector disclosed herein also uses intensifier actuation fluid for direct needle control. Alternatively, intensified fuel pressure may be used for direct needle control. This is not preferred however, because of the valving difficulties at the intensified pressure. Of course, substantially any method of direct needle control may be used with the present invention, as it is the combination of direct needle control, however done, together with the ability to store fuel at the intensified pressure in isolation from the intensifier during injection, that provides the repeatability, efficiency and durability characteristics of the present invention.

Figure 3:
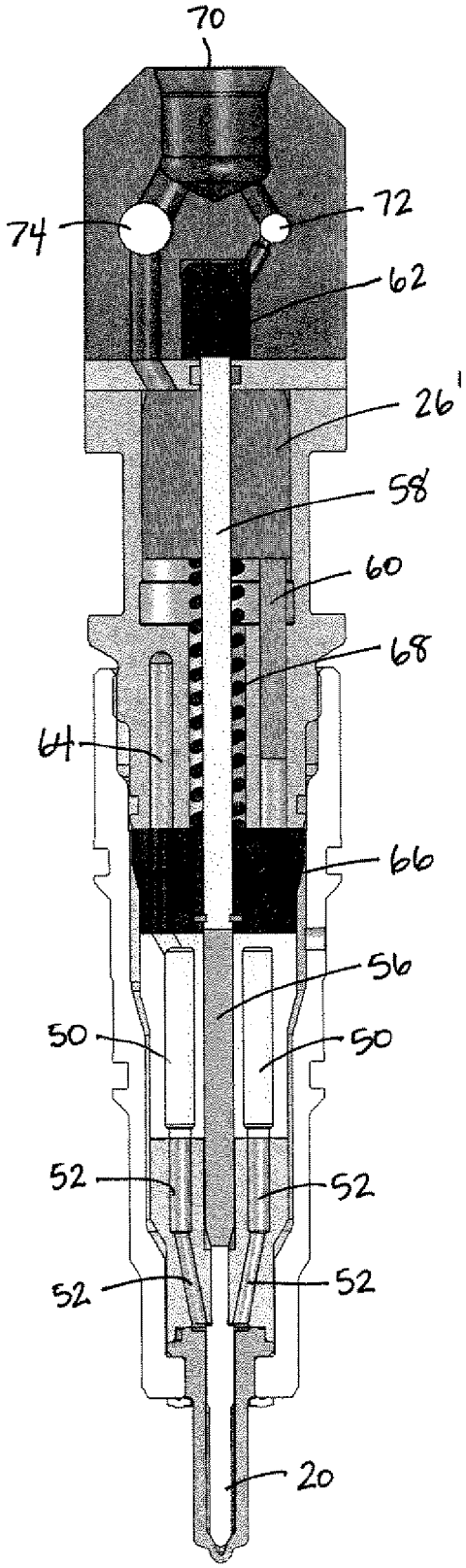
FIG. 3 is a cross section of an alternate fuel injector that may be operated by a method accordance with the present invention.

Now referring to FIG. 3, and alternate embodiment of injector that may be used with the present invention may be seen. This embodiment is functionally the same as the previously described embodiment, though has a more convenient mechanical arrangement. The embodiment of FIG. 3 includes a needle 20 with large storage regions 50 and generous porting 52 between the needle 20 and the storage regions 50. The major difference between the embodiment of FIG. 3 and FIG. 1, however, is the general arrangement of the intensifier and direct needle control. In particular, needle control pins 56 and 58 extend upward along the axis of the injector to a direct needle control piston 62 adjacent the top of the injector.

In the embodiment of FIG. 3, the intensifier piston 26' is concentric with the needle control pin 58 and operates against multiple plunger pins 60. In one embodiment, this comprises three plunger pins, plumbed together and ported to storage regions 50 through porting not shown in the Figure. Between the plunger pins 60 are additional storage volumes 64, which are also plumbed to the storage volumes 50. The upper needle control pin 58 in this embodiment is encouraged to its downward most position by a relatively light spring 66, with an additional return spring 68 for the intensifier piston 26. The return of the plunger pins 60 is by way of fuel pressure provided underneath the plunger pins 60 from a relatively low pressurized fuel source through a ball valve which subsequently seals against intensified fuel pressures, as is well known in the art.

The operation of the embodiment of FIG. 3 is as follows. Engine oil under pressure is provided through port 70 to a small spool valve 72, shown schematically, and a larger spool valve 74, also shown schematically. The two spool valves 72 and 74 are preferably three-way valves. The spool valve 72 provides direct needle control, and when porting the engine oil through port 70 to the top of piston 62, holds the needle 20 down against the needle seat to seal the same against fuel at intensified pressure. Thus as before, spool valve 74 may be used to port engine oil through port 70 to the top of intensifier piston 26' to intensify the fuel pressure, with the intensification remaining typically through a plurality of injections as controlled by the needle control spool valve 72. When the intensifier piston 26' approaches the bottom of its range of travel, spool valve 74 is actuated to cut off engine oil communication between port 70 and the top of the intensifier piston 26', and instead will couple the region above intensifier 26' to a vent or low pressure oil sump, typically directly or indirectly back to the engine crankcase. During this time a ball valve similar to ball valve 54 of FIG. 1 is used to retain the intensification pressure on the remaining intensified fuel while the intensifier is cycled to intensify another charge, preferably between injection events.

Again, the method of operating an injector with intensified fuel storage in accordance with the present invention is to operate the intensifier between injection events, or even injection sub-events if time allows, to provide intensified fuel to the intensified fuel storage volume, and then to isolate that stored intensified fuel from the intensifier before or as the intensifier is returned to its un-actuated position in readiness for its next intensification stroke. If a simple check valve such as a ball check valve is used for that isolation, the check valve will close as the intensifier is returned to its un-actuated position in readiness for its next intensification stroke.

Thus, like the method disclosed in U.S. Patent Application Publication No. 2010/0012745, the present invention method can very substantially reduce the energy loss of other types of prior art intensifier type fuel injectors and methods of operation by minimizing the fraction of the fuel that is raised to the intensified pressure but not injected, yet greatly reduces the pressure spikes and increases the repeatability of an injector with intensified fuel storage in comparison to the method of U.S. Patent Application Publication No. 2010/0012745, all with an increase in durability of the injectors used because of the limiting of the pressure spikes. In that regard, the pressure spikes put unnecessary forces on the injector tip, which can lead to a premature failure of the tip.

While certain preferred embodiments of the present invention have been disclosed and described herein for purposes of illustration and not for purposes of limitation, it will be understood by those skilled in the art that various changes in form and detail may be made in the method and in the injector used to practice the method without departing from the spirit and scope of the invention.

What is claimed is:

1. In an engine, a method of operating an intensifier type fuel injector having an intensifier piston responsive to actuation fluid pressure and at least one intensifier plunger in a plunger cylinder having a movement in a first direction to intensify the pressure of the fuel, and in a second direction when actuating fluid pressure is removed from the intensifier piston for refilling the plunger cylinder with fuel for intensification while the plunger moves in a second direction, the intensifier plunger having a limited stroke, comprising:

a) closing a needle of the fuel injector b) intensifying fuel in a needle chamber surrounding the needle and in at least one intensified fuel storage volume within the injector to a desired pressure using the intensifier;

c) isolating the intensified fuel in the needle chamber surrounding the needle and in the at least one intensified fuel storage volume from the intensifier plunger by removing the actuating fluid pressure from the intensifier piston before d); and, d) controllably opening and closing the needle for successive multiple fuel injection events while the intensified fuel is isolated from the intensifier plunger e) then repeating b) through d).

2. The method of claim 1 wherein the intensifier type fuel injector further comprises a check valve a) between the plunger cylinder, and b) the needle chamber surrounding the needle and the at least one intensified fuel storage volume, and wherein isolating the intensified fuel in the needle chamber surrounding the needle and in the at least one intensified fuel storage volume from the intensifier plunger comprises removing the actuating fluid pressure from the intensifier piston to close the check valve by movement of the plunger toward the second direction.

3. The method of claim 1 wherein in b), substantially all fuel in the plunger cylinder is expelled from the plunger cylinder.

4. The method of claim 3 wherein a controller for the injector also estimates the amount of intensified fuel the intensifier needs to replenish the needle chamber surrounding the needle and the at least one intensified fuel storage volume with intensifier fuel with the desired pressure, and initiates b) when fuel pressure in the needle chamber surrounding the needle and the at least one intensified fuel storage volume can be replenished by a single intensification of fuel then in the plunger cylinder.

5. The method of claim 4 wherein a measure of intensified fuel pressure is used for correction of the control system based on errors in the estimation by the control system.

6. The method of claim 5 wherein the intensifier actuation fluid pressure is used as a measure of intensified fuel pressure.

7. The method of claim 6 further comprising sensing the error in the amount of intensified fuel the intensifier needs to replenish the needle chamber surrounding the needle and the at least one intensified fuel storage volume with intensified fuel to the desired pressure.

8. The method of claim 7 wherein sensing the error in the amount of intensified fuel the intensifier needs to replenish the needle chamber surrounding the needle and the at least one intensified fuel storage volume with intensified fuel to the desired pressure comprises sensing a final position of the intensifier piston and plunger when in b), the motion in the first direction ends, and adjusting the amount of fuel being intensified in b) in a subsequent intensification to then obtain a final position approaching a limit in motion in the first direction.

9. In an engine, a method of operating an intensifier type fuel injector having an intensifier piston responsive to actuation fluid pressure and at least one intensifier plunger in a plunger cylinder having a movement in a first direction to intensify the pressure of the fuel, and in a second direction when actuating fluid pressure is removed from the intensifier piston for refilling the plunger cylinder with fuel for intensification while the plunger moves in a second direction, the intensifier plunger having a limited stroke, comprising:

a) closing a needle of the fuel injector;

b) intensifying fuel in a needle chamber surrounding the needle and in at least one intensified fuel storage volume within the injector to a desired pressure using the intensifier wherein substantially all fuel in the plunger cylinder is expelled from the plunger cylinder;

c) isolating the intensified fuel in the needle chamber surrounding the needle and in the at least one intensified fuel storage volume from the intensifier plunger by a check valve 1) between the plunger cylinder, and 2) the needle chamber surrounding the needle and the at least one intensified fuel storage volume, and wherein isolating the intensified fuel in the needle chamber surrounding the needle and in the at least one intensified fuel storage volume from the intensifier plunger comprises removing the actuating fluid pressure from the intensifier piston to close the check valve by movement of the plunger in the second direction prior to d);

d) controllably opening and closing the needle for multiple successive fuel injection events while the intensified fuel is isolated from the plunger cylinder; and e) then repeating b) through d).

10. The method of claim 9 wherein in b), substantially all fuel in the plunger cylinder is expelled from the plunger cylinder.

11. The method of claim 10 wherein a controller for the injector also estimates the amount of intensified fuel the intensifier needs to replenish the needle chamber surrounding the needle and the at least one intensified fuel storage volume with intensifier fuel with the desired pressure, and initiates b) when fuel pressure in the needle chamber surrounding the needle and the at least one intensified fuel storage volume can be replenished by a single intensification of fuel then in the plunger cylinder.

12. The method of claim 11 wherein a measure of intensified fuel pressure is used for correction of the control system based on errors in the estimation by the control system.

13. The method of claim 12 wherein the intensifier actuation fluid pressure is used as a measure of intensified fuel pressure.

14. The method of claim 13 further comprising sensing the error in the amount of intensified fuel the intensifier needs to replenish the needle chamber surrounding the needle and the at least one intensified fuel storage volume with intensified fuel to the desired pressure.

15. The method of claim 14 wherein sensing the error in the amount of intensified fuel the intensifier needs to replenish the needle chamber surrounding the needle and the at least one intensified fuel storage volume with intensified fuel to the desired pressure comprises sensing a final position of the intensifier piston and plunger when in b), the motion in the first direction ends, and adjusting the amount of fuel being intensified in b) in a subsequent intensification to then obtain a final position approaching a limit in motion in the first direction.

* * * * *